United States Patent [19].

Gaffney et al.

[11] Patent Number: 4,953,461

[45] Date of Patent: Sep. 4, 1990

[54] SYSTEM FOR CONTINUOUSLY ROTATING PLATE A BLANKET CYLINDERS AT RELATIVELY DIFFERENT SURFACE SPEEDS

[75] Inventors: John M. Gaffney, Kittery Point, Me.; Wilfred R. Gelinas, Jewett City, Conn.; Joel C. Hern, Dover, N.H.; Charles L. Krouse, Ashaway, R.I.

[73] Assignee: Harris Graphics Corporation, Dover, N.H.

[21] Appl. No.: 196,439

[22] Filed: May 20, 1988

[51] Int. Cl.[5] ..... B41F 7/12; B41F 13/14

[52] U.S. Cl. ..... 101/142; 101/492

[58] Field of Search ..... 101/248, 181, 177, 176, 101/217, 220, 137, 142, 492, 485, 486, 137, 142, 216, 219

[56] References Cited

U.S. PATENT DOCUMENTS

| | | | |
|---|---|---|---|
| 2,164,852 | 7/1939 | Zimmerman | 101/91 |
| 2,220,903 | 11/1940 | Higgins et al. | 101/92 |
| 2,619,901 | 12/1952 | Harrold | 101/177 |
| 2,906,143 | 9/1959 | Musser | 101/248 |
| 3,565,006 | 2/1971 | Stewart | 101/248 |
| 3,593,661 | 7/1971 | Tripp | 101/177 |
| 3,701,464 | 10/1972 | Crum | 101/181 X |
| 3,717,092 | 2/1973 | Crum | 101/181 X |
| 3,724,368 | 4/1973 | Treff | 101/248 |
| 3,746,957 | 7/1973 | Forster et al. | 101/181 X |
| 3,791,294 | 2/1974 | Shelding et al. | 101/248 |
| 4,072,104 | 2/1978 | Schaffer | 101/248 |
| 4,114,534 | 9/1979 | Kudlich et al. | 101/181 X |
| 4,217,823 | 8/1980 | Burger | 101/246 |
| 4,236,448 | 12/1980 | Wieland | 101/248 X |
| 4,363,220 | 12/1982 | Ury et al. | 101/248 X |
| 4,428,287 | 1/1984 | Greiner | 101/248 X |
| 4,428,289 | 1/1984 | Fair | 101/248 |
| 4,429,630 | 2/1984 | Hajek | 101/248 X |
| 4,457,231 | 7/1984 | Kawaguchi | 101/248 X |
| 4,458,893 | 7/1984 | Rah | 101/248 X |
| 4,500,082 | 2/1985 | Izume | 101/248 X |
| 4,541,335 | 9/1985 | Tokunow et al. | 101/248 X |
| 4,581,993 | 4/1986 | Scheneberger | 101/248 X |
| 4,602,562 | 7/1986 | Ottenhues et al. | 101/245 X |
| 4,651,641 | 3/1987 | Kawata et al. | 101/217 |
| 4,694,749 | 9/1987 | Takeuchi et al. | 101/181 X |

FOREIGN PATENT DOCUMENTS

| | | | |
|---|---|---|---|
| 154836 | 9/1983 | European Pat. Off. | 101/248 |
| 21860 | 2/1981 | Japan | 101/248 |
| 123666 | 7/1984 | Japan | 101/248 |
| 214657 | 12/1984 | Japan | 101/248 |
| 58854 | 4/1989 | Japan | 101/248 |
| 2065033 | 6/1981 | United Kingdom | 101/248 |

OTHER PUBLICATIONS

Publication Entitled Power Plant Employs Harmonic Drive Reducer from Pacific Factory, Dec., 1965.

Publication Entitled Use Harmonic Drives as High--Ratio Differentials from Feb., 1968, Power Transmission Design, Industrial Publishing Co.

*Primary Examiner*—J. Reed Fisher

*Attorney, Agent, or Firm*—Tarolli, Sunheim & Covell

[57] ABSTRACT

An improved printing apparatus and method includes plate and blanket cylinders which are rotated at different surface speeds during printing on material. Since the plate and blanket cylinders are rotated at different surface speeds, the area on a blanket cylinder which engages a given portion of the surface on a plate cylinder is changed on each revolution of the blanket cylinder. Therefore, the area of a blanket cylinder which is engaged by the gap in the plate cylinder changes during a printing operation. In addition, the area where an image is applied to the blanket cylinder is moved relative to the surface of the blanket cylinder is tend to minimize build up of ink on the blanket cylinder during printing. The plate and blanket cylinders are driven at different surface speeds by a drive assembly which includes a harmonic drive unit.

25 Claims, 4 Drawing Sheets

SYSTEM FOR CONTINUOUSLY ROTATING PLATE A BLANKET CYLINDERS AT RELATIVELY DIFFERENT SURFACE SPEEDS

BACKGROUND OF THE INVENTION

The present invention relates to a new and improved offset printing apparatus and method in which an image is transferred from a plate cylinder to a blanket cylinder during printing.

Known printing presses include a plate cylinder upon which a printing plate is mounted. During a printing operation, an image is transferred from the printing plate to a blanket cylinder. The image is then transferred from the blanket cylinder to the material being printed.

Although the printing plate normally extends almost completely around the plate cylinder, there is frequently a small gap at the ends of the printing plate. This gap extends longitudinally along the peripheral surface of the plate cylinder in a direction parallel to the central axis of the plate cylinder. Since the peripheral surfaces of the printing plate and blanket cylinder are in rolling engagement during operation of a printing press, the gap strikes the blanket cylinder repeatedly at the same location. This tends to result in wear, deformation and/or damage to a blanket on the blanket cylinder. Of course, this is detrimental to printing quality.

During operation of a printing press, ink tends to build up on the blanket cylinder at locations where ink is repetitively applied to the blanket cylinder by the printing plate. This build up becomes particularly objectionable when the printing plate has relatively dark or high ink density areas adjacent to light or relatively low ink density areas. In order to maintain the requisite quality of printing, it is necessary to remove the ink build up by periodically washing the blanket cylinders. Of course, this reduces productivity.

SUMMARY OF THE PRESENT INVENTION

The printing apparatus and method of the present invention tends to minimize ink build up and blanket wear in an offset printing press. This is accomplished by rotating the plate and blanket cylinders at different surface speeds during printing on sheet material.

Since the plate and blanket cylinders are rotating at different surface speeds, the area on a blanket cylinder which engages a given portion of the surface on a plate cylinder is changed on each revolution of the blanket cylinder. Therefore, the area of a blanket cylinder which is engaged by the gap in the plate cylinder changes during a printing operation. This prevents the gap in the plate cylinder from repeatedly striking the blanket cylinder at the same location to thereby minimize blanket wear, deformation and/or damage during the printing operation.

Since the plate and blanket cylinders are being rotated at different surface speeds, the area where an image is applied to the blanket cylinder is moved relative to the surface of the blanket cylinder during printing. This tends to minimize build up of ink on the blanket cylinder to thereby eliminate or reduce the need for washing of the blanket cylinder.

Accordingly, it is an object of this invention to provide a new and improved method and apparatus wherein plate and blanket cylinders are rotated at different surface speeds while printing.

Another object of this invention is to provide a new and improved method and apparatus wherein the surface area on the blanket cylinder which engages a given portion of a surface area on the plate cylinder is changed on each revolution of the blanket cylinder during printing.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
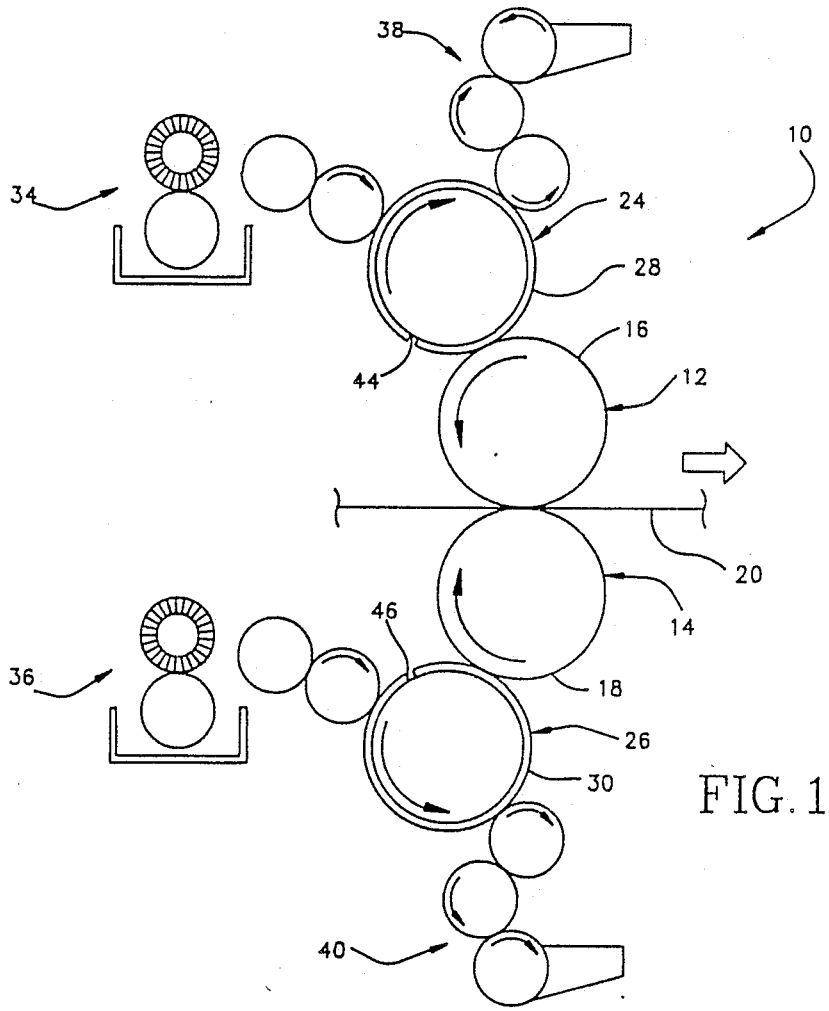
FIG. 1 is a schematic illustration of a lithographic perfecting printing press which is constructed and operated in accordance with the present invention.

As representative of the present invention, a lithographic perfecting printing press 10 (FIG. 1) includes a pair of blanket cylinders 12 and 14 having continuous cylindrical peripheral surfaces 16 and 18 which roll on opposite sides of a sheet material web 20 during a printing operation. A pair of plate cylinders 24 and 26 carry printing plates 28 and 30 having cylindrical peripheral surfaces which engage the surfaces 16 and 18 of the blanket cylinders 12 and 14. During printing on the web 20, images are transferred from the plate cylinders 24 and 26 to the blanket cylinders 12 and 14 and from the blanket cylinders to opposite sides of the sheet material web 20. Although the blanket and plate cylinders 12, 14, 24 and 26 all have cylindrical peripheral surfaces of the same diameter, it is contemplated that the blanket cylinders could have a diameter which is twice as great as the diameter of the plate cylinders.

A pair of dampeners 34 and 36 apply dampening solution to the printing plates 28 and 30 on the plate cylinders 24 and 26. A pair of inkers 38 and 40 apply ink to the printing plates 28 and 30 on the plate cylinders 24 and 26. To transfer an image from the plate cylinders 24 and 26 to the blanket cylinders 12 and 14, the ink which is applied to the printing plates 28 and 30 is transferred to the surfaces 16 and 18 of the blanket cylinders. The ink is transferred from the blanket cylinders 12 and 14 to the sheet material web 20.

During operation of the printing press 10, gaps 44 and 46 at opposite ends of the printing plates 28 and 30 on the plate cylinders 24 and 26 repeatedly impact against the continuous cylindrical surfaces 16 and 18 of the blanket cylinders 12 and 14. Thus, the gaps 44 and 46 extend longitudinally along the plate cylinders 24 and 26 in directions parallel to the central axes of the plate cylinders. On each revolution of the plate cylinders, the gaps 44 and 46 strike the surfaces 16 and 18 of the blanket cylinders 12 and 14. If the gaps 44 and 46 repeatedly strike the blanket cylinders 12 and 14 at the same location on the surfaces 16 and 18 of the blanket cylinders, the blankets may become worn, deformed and/or damaged. In addition, if the images on the printing plates 28 and 30 are repeatedly applied to the same locations on the surfaces 16 and 18 of the blanket cylinders 12 and 14, ink tends to build up in areas of high ink density.

In accordance with a feature of the present invention, wear of the surfaces 16 and 18 of the blanket cylinders 12 and 14 and build up of ink on the surfaces of the blanket cylinders is minimized by continuously rotating the blanket cylinders 12 and 14 at a surface speed which is different than the surface speed of the plate cylinders 24 and 26 during printing on the sheet material 20. This results in a continuous change in the areas on the surfaces 16 and 18 of the blanket cylinders 12 and 14 which are engaged by given areas on the surfaces 28 and 30 of the plate cylinders 24 and 26. Therefore, the gaps 44 and 46 in the plate cylinders 24 and 26 engage different areas on the surfaces 16 and 18 of the blanket cylinders 12 and 14 on each revolution of the blanket cylinders. By shifting the area of engagement of the plate cylinder gaps 44 and 46 with the surfaces 16 and 18 of the blanket cylinders 12 and 14 on each revolution on the blanket cylinders, wear of the blankets on the blanket cylinders tends to be minimized because the locations on the blankets which are struck by the plate cylinder gaps are moved along the entire surface area of the blanket cylinders rather than being concentrated in one location on each of the blanket cylinders.

The build up of ink at particular locations on the surfaces 16 and 18 of the blanket cylinders 12 and 14 is prevented by rotating the plate cylinders 24 and 26 at a different surface speed than the blanket cylinders 12 and 14. This is because image areas of high ink density are shifted around the periphery of the blanket cylinders 12 and 14 during a printing operation. This tends to equalize the rate of application of ink over the peripheral surface areas of the blanket cylinders 12 and 14.

Figure 2:
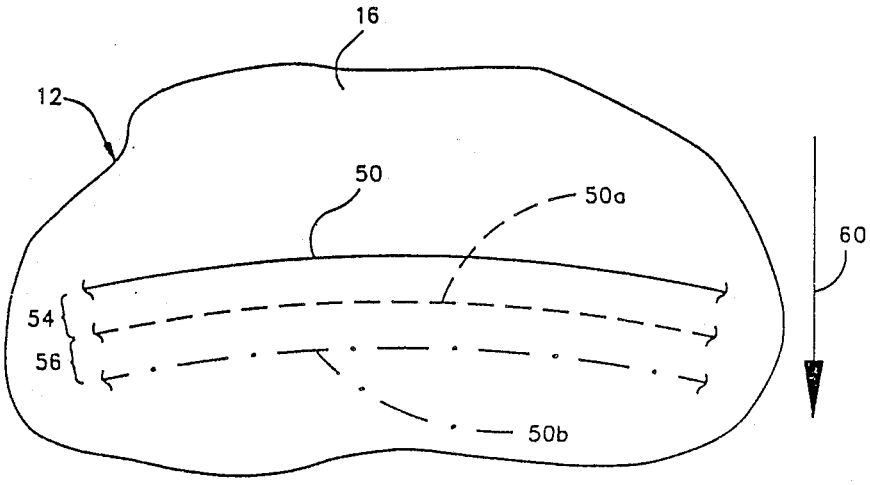
FIG. 2 is a schematic illustrating depicting the manner in which the location of an image transferred from a plate cylinder to a blanket cylinder is moved along the surface of the blanket cylinder during operation of the printing press of FIG. 1.

During printing on the sheet material 20 with the lithographic printing press 10, a portion of an image on a printing plate 28 on the plate cylinder 24 is transferred to a different location on the surface 16 of the blanket cylinder 12 on each revolution of the blanket cylinder. Thus, an image, represented by a solid line 50 in FIG. 2, is applied to a first area on the surface 16 of the blanket cylinder 12 during a revolution of the blanket cylinder. During a next succeeding revolution of the blanket cylinder 12, the same image, represented by a dashed line 50*a*, is applied to a second area on the surface 16 of the blanket cylinder. The image 50*a* is offset from the image 50 by a distance 54 along the surface 16 of the blanket cylinder 12.

On a next succeeding revolution of the blanket cylinder 12, an image 50*b*, indicated by a dashed-dot line in FIG. 2, is applied to the surface 16 of the blanket cylinder 12 by the plate cylinder 24. The image 50*b* is the same as the images 50 and 50*a*. However, the image 50*b* is offset from the image 50*a* by a distance 56. The distance 56 is equal to the distance 54 although these distances may be unequal. Images applied to the surface 18 of the blanket cylinder 14 by the plate cylinder 26 are moved along the surface of the blanket cylinder 14 during printing in the same manner as they are moved along the surface 16 of the blanket cylinder 12.

The blanket cylinder 12 and plate cylinder 24 continuously rotate at different surface speeds during printing on the sheet material web 20. Thus, although the blanket and plate cylinders 12 and 24 have the same diameter, they have different surface speeds. Therefore, the cylindrical peripheral surfaces 16 and 28 of the plate and blanket cylinders 12 and 24 both roll on and slide relative to each other during printing.

In the illustrated embodiment of the invention, the blanket cylinder 12 is rotated at a surface speed which is slightly slower than the surface speed at which the plate cylinder 24 rotates. Therefore, the image 50*a* (FIG. 2) is offset from the image 50 by the distance 54 in the direction of rotation of the surface 16 of the blanket cylinder 12, indicated by the arrow 60 in FIG. 2. Similarly, the location where the image 50*b* is transferred to the surface 16 of the blanket cylinder 12 is slightly ahead of the location where the image 50*a* is applied to the surface 16 of the blanket cylinder. However, if desired, the blanket cylinder 16 could be rotated at a surface speed which is slightly faster than the surface speed at which the plate cylinder 24 rotates. If this was done, the location where the first image 50 was transferred to the surface 16 of the blanket cylinder 12 would be ahead of the location where the next succeeding image 50*a* would be transferred to the surface of the blanket cylinder.

The extent of sliding movement between the surfaces of the blanket cylinder 12 and plate cylinder 24 is small enough to have either no or an acceptably low detrimental effect on the printing applied to the web 20 by the blanket cylinder 12. For many types of printing, it is believed that the areas of engagement of the surfaces of the blanket cylinder 12 and plate cylinder 24 can be moved by 0.0001 to 0.0004 inches along the surface of the blanket cylinder on each revolution of the blanket cylinder. Thus, in FIG. 2, the equal distances 54 and 56 are between 0.0001 and 0.0004 inches. In one specific embodiment of the invention, the distances 54 and 56 were 0.0003 inches. However, the specific distance 54 and 56 which the images 50 are offset relative to each other on succeeding revolutions of the blanket cylinder 12 will depend upon the difference between the surface speeds of the blanket cylinder 12 and plate cylinder 24.

The foregoing description has described the manner in which the images 50, 50*a*, and 50*b* are offset along the surface 16 of the blanket cylinder 12. It should be understood that images are also offset along the surface 18 of the blanket cylinder 14 in the same manner. This is because the plate cylinders 24 and 26 rotate at the same surface speed and the blanket cylinders 12 and 14 rotate at the same surface speed.

Drive Assembly

During printing on the sheet material web 20, a drive assembly 66 (FIG. 3) continuously rotates the blanket cylinder 14 and plate cylinder 26 at different surface speeds. The drive assembly 66 includes a main drive 68 which transmits a major portion of the drive forces between the blanket cylinder 14 and plate cylinder 26. The main drive 68 is connected with and is driven by a press drive motor and drive train in a known manner.

A secondary drive 70 transmits a minor portion of the drive forces between the blanket cylinder 14 and plate cylinder 26. The secondary drive 70 cooperates with the main drive 68 to cause the blanket cylinder 14 and plate cylinder 26 to continuously rotate at different surface speeds during printing on the sheet material web 20. Although the surface speeds at which the blanket cylinder 14 and cylinder 26 rotate are different, the surface speeds maintain the same ratio relative to each other during acceleration or deceleration of the blanket cylinder 14 and plate cylinder 26.

A harmonic drive unit 74 combines forces from the main drive 68 and secondary drive 70 to rotate the blanket cylinder 14. The harmonic drive unit 74 is commercially available and has the same general construction disclosed in U.S. Pat. No. 2,906,143 issued Sept. 29, 1959 and entitled Strain Wave Gearing. Of course, other types of differential drive units could be used to combine the inputs from the main drive 68 and secondary drive 70 if desired.

The main drive 68 includes a plate cylinder gear 78 which is fixedly connected to a shaft 80 of the plate cylinder 26. The plate cylinder shaft 80 is mounted for rotation in bearings 82 disposed in a side frame 84 of the lithographic printing press 10. The plate cylinder gear 78 is disposed in a coaxial relationship with the plate cylinder 26.

The main drive 68 also includes a blanket cylinder gear 88 which meshes with the plate cylinder gear 78 and is driven by the press drive train. The blanket cylinder gear 88 is connected with a main input member or housing 90 of the harmonic drive unit 74. The blanket cylinder gear 88 is disposed in a coaxial relationship with the blanket cylinder 14. The blanket cylinder gear 88 is formed as one piece with the housing or input member 90 of the harmonic drive unit 74. However, it is contemplated that the blanket cylinder gear 88 could be formed separately from and connected with the housing or main input member 90 of the harmonic drive unit 74.

The secondary drive 70 includes a planetary gear set 94 which is disposed in a coaxial relationship with the plate cylinder 26. The planetary gear set 94 is driven by an extension 96 of the plate cylinder shaft 80. The planetary gear set 94 includes a sun gear 100 which is fixedly connected with and driven by the plate cylinder shaft extension 96. A plurality of planet gears 102 are rotatably mounted on a planet gear carrier 104.

The planet gears 102 are disposed in meshing engagement with and are driven by the sun gear 100. The planet gears 102 are also disposed in meshing engagement with an annular ring gear 106. The ring gear 106 is driven by the planet gears 102 and is connected with a housing 108 of the planet gear set 94. A cylindrical output end portion 110 of the housing 108 is rotatably supported on the extension 96 of the plate cylinder shaft 80.

The secondary drive 70 also includes a pair of spur gears 112 and 114. The spur gears 112 and 114 transmit drive forces from the planetary gear set 94 to the harmonic drive unit 74. The spur gear 112 is fixedly secured to the output end portion 110 of the housing 108 for the planetary gear set 94. A spur gear 114 meshes with the gear 112 and is fixedly connected to an input shaft 118 for the harmonic drive unit 74.

The harmonic drive unit 74 drives the blanket cylinder 14 under the combined influence of forces transmitted by the blanket cylinder gear 88 and spur gear 114. The harmonic drive unit includes a main input member or cylindrical housing 90 which is secured to the blanket cylinder gear 88. The rigid cylindrical housing 90 is rotatably supported on a rotatable blanket cylinder shaft 122 by bearings 124. The rigid housing or input member 90 has a circular array of internal teeth 128 (FIGS. 4 and 5) which meshingly engage external teeth 130 on a flexible output member 134. The flexible output member 134 has a generally cup shaped configuration with a circular end wall 136 (FIG. 4) which is fixedly connected to one end of the blanket cylinder shaft 122.

A second input member or wave generator 140 is disposed in one end of the output member 134. The wave generator 140 is fixedly connected with the gear 114 by the input shaft 118. Bearings 142 (FIG. 5) are provided between the outside of the wave generator 140 and inner side surface of the flexible output member 134.

Upon rotation of the spur gear 114 and input shaft 118, the wave generator 140 rotates to flex the output member 134. This moves areas of meshing engagement between the external teeth 130 on the output member 134 and internal teeth 128 on the input member 90 around the circular array of internal teeth on the input member. There are fewer external teeth 130 on the output member 134 than there are internal teeth 128 on the input member 90. Therefore, rotation of the wave generator 140 flexes the output member 134 and causes the external teeth 130 on the output member to cooperate with the internal teeth 128 on the input member 90 to rotate the output member relative to the input member. This results in rotation of the blanket cylinder shaft 122 and blanket cylinder 18 relative to the blanket cylinder gear 88 and input member 90 of the harmonic drive unit 74.

In the illustrated embodiment of the invention, the plate cylinder gear 78 is a ten pitch-72 tooth gear. The blanket cylinder gear 88 is a ten pitch-73 tooth gear. Therefore, upon each revolution of the plate cylinder gear 78, the blanket cylinder gear 88 and input member 90 to the harmonic drive unit 74 rotate through a distance which is slightly less than one complete revolution.

The planetary gear set 94 has a 200-to-1 drive ratio. The spur gears 112 and 114 have a 5-to-1 drive ratio with the spur gear 112 being a twelve pitch-29 tooth gear and the spur gear 114 being a twelve pitch-145 tooth gear. The harmonic drive unit 74 has a 73-to-72 drive ratio. Thus, there are 156 internal teeth 128 on the input member 90 and 154 external teeth 130 on the output member 134.

During operation of the lithographic printing press 10, the main press drive train (not shown) drives the blanket cylinder gear 88. Rotation of the blanket cylinder gear 88 rotates the plate cylinder gear 78 and plate cylinder 26 at a slightly faster speed than the blanket cylinder gear.

Drive forces from the blanket cylinder gear 88 are transmitted to the blanket cylinder 18 through the internal teeth 128 on the input member 90 of the harmonic drive unit 74 and through the external teeth 130 on the output member 134 which is fixedly connected to the blanket cylinder. In the illustrated embodiment of the invention, the ratio of the number of internal teeth 128 on the input member 90 to the number of external teeth 130 on the output member 134 has been selected to drive the blanket cylinder 18 at the same surface speed as the plate cylinder 26 in the absence of rotation of the wave generator 140 by the secondary drive 70.

The secondary drive 70 rotates the input shaft 118 and wave generator 140 in the opposite direction from the direction of rotation of the blanket cylinder gear 88. Therefore, the input of the secondary drive 70 is effective to retard the rotation of the blanket cylinder 14. This results in the blanket cylinder 14 being driven at a slightly slower surface speed than the plate cylinder 26.

In the illustrated embodiment of the invention, the gear ratio of the blanket cylinder drive to the plate cylinder drive is less than one-to-one so that the blanket cylinder 14 has a surface speed which is less than the surface speed of the plate cylinder 26. However, the gear ratio of the blanket cylinder drive to the plate cylinder drive could more than one-to-one so that the blanket cylinder 14 would have a surface speed which is greater than the surface speed of the plate cylinder 26. By having the gear ratio of the blanket cylinder drive to the plate cylinder drive different than the one-to-one ratio of the diameter of the blanket cylinder 18 to the diameter of the plate cylinder 26, the plate and blanket cylinders are driven at different surface speeds.

It should be understood that the foregoing specific construction of the gears in the drive assembly 66 and the ratios of the gears to each other has been set forth herein for purposes of clarity of illustration and not for purposes of limiting the invention. It is contemplated that different embodiments of the invention will be made with gears having different constructions and different drive ratios. It should be understood that although it is preferred to use the harmonic drive unit 74, other known types of differential drives could be used if desired.

Figure 3:
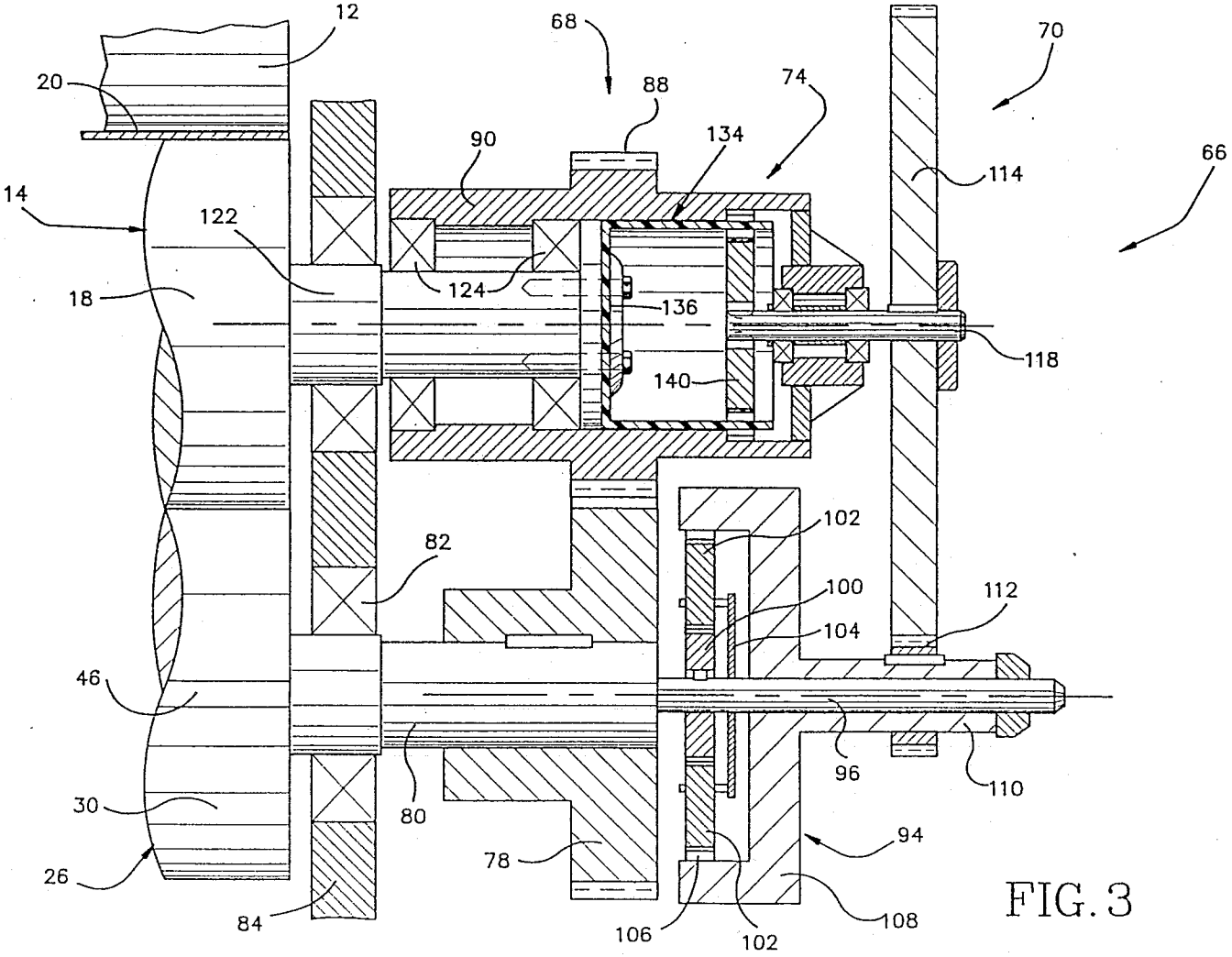
FIG. 3 is a schematic sectional view illustrating the construction of a drive assembly used in the printing press of FIG. 1 to drive the plate and blanket cylinders at different surface speeds.
Figure 4:
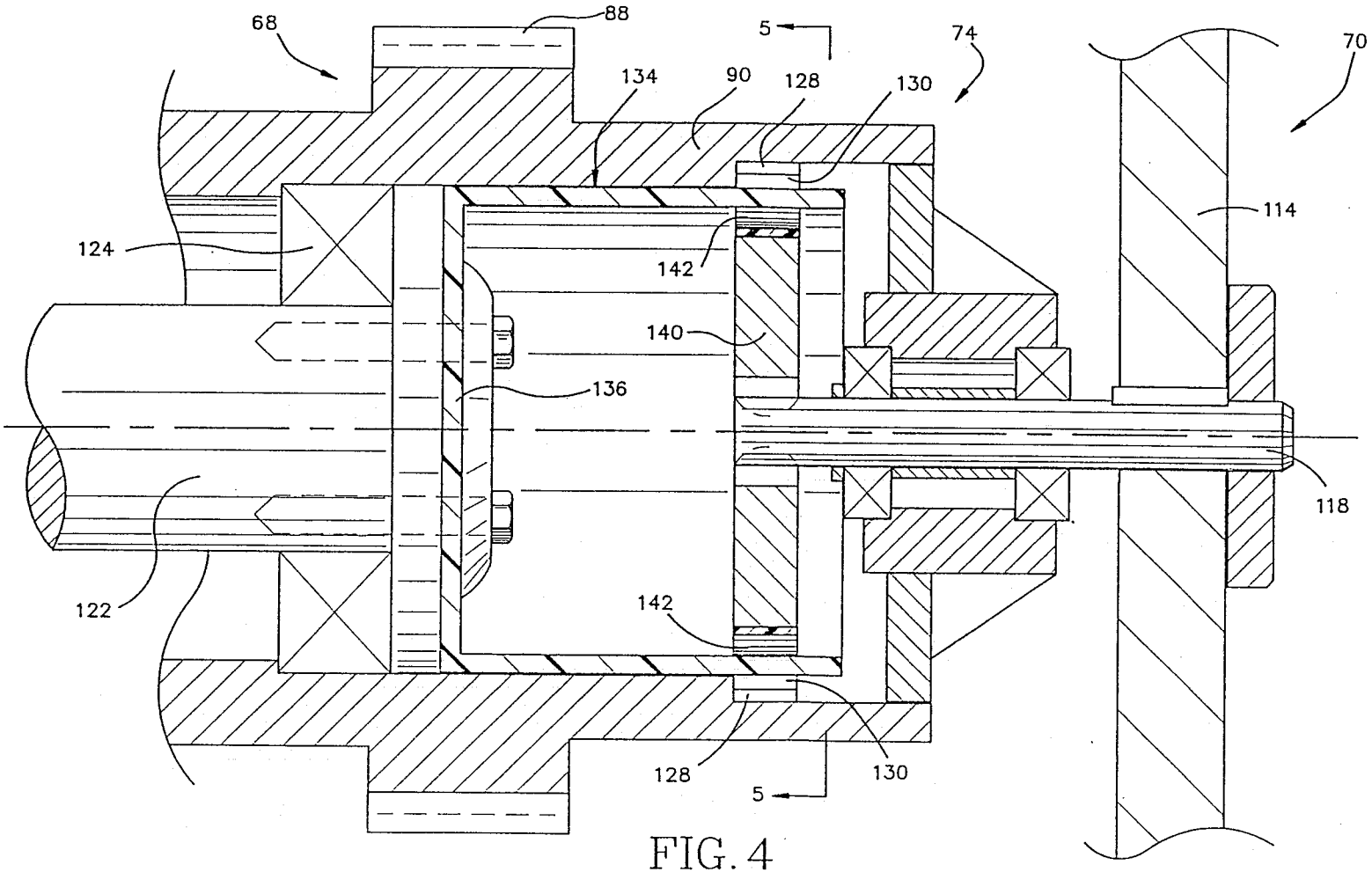
FIG. 4 is an enlarged sectional view of a harmonic drive unit used in the drive assembly of FIG. 3.
Figure 5:
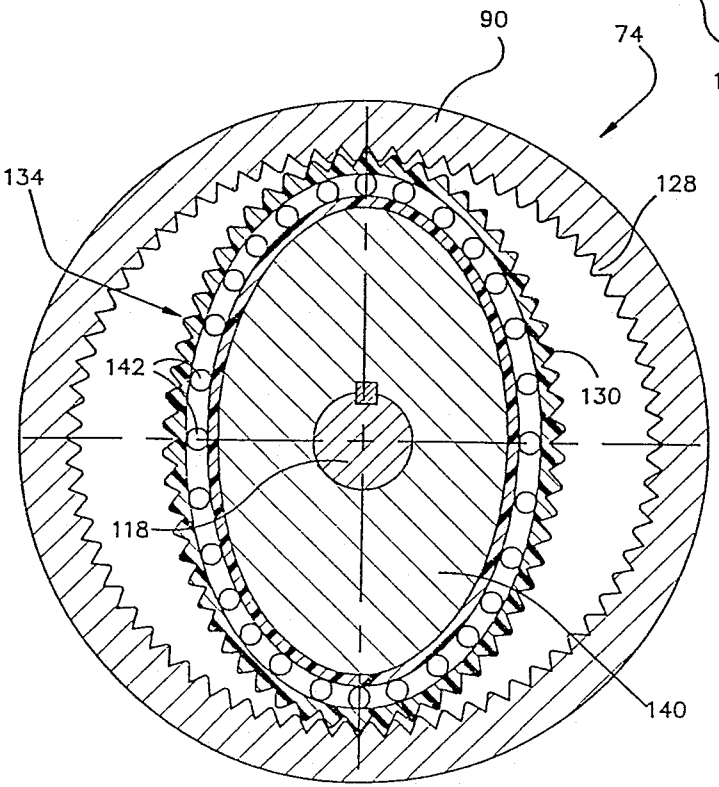
FIG. 5 is a schematic sectional view taken generally along the line 5—5 of FIG. 4, illustrating the relationship between a pair of input members and an output member of the harmonic drive unit.

Although only the drive assembly 66 for the blanket cylinder 14 and plate cylinder 26 has been shown in FIGS. 3–5, it should be understood that a similar drive assembly having the same construction interconnects the blanket cylinder 12 and plate cylinder 28. It should also be understood that although the blanket cylinders 12 and 14 and plate cylinders 24 and 26 have been shown in FIGS. 1 and 3 as having the same diameter, it is contemplated that the blanket cylinders 12 and 14 could have diameters which are twice as great as the diameters of the plate cylinders 24 and 26. Regardless of the ratios of the diameters of the plate cylinders 24 and 26 and blanket cylinders 12 and 14, the plate cylinders are driven at different surface speed than the blanket cylinders during printing on the sheet material 20.

Second Embodiment of the Invention

In the embodiment of the invention illustrated in FIGS. 1–5, the drive assembly 66 is constructed to have the harmonic drive unit 74 connected with the blanket cylinder 14 and the planetary gear set 94 connected with the plate cylinder 26. In the embodiment of the invention illustrated in FIG. 6, the harmonic drive unit is connected with the plate cylinder and the planetary gear set is connected with the blanket cylinder. Since the components of the embodiment of the invention illustrated in FIG. 6 are generally similar to the components of the embodiment of invention illustrated in FIGS. 1–5, similar numerals will be utilized to designate similar components, the suffix letter "c" being associated with the numerals of FIG. 6 in order to avoid confusion.

Figure 6:
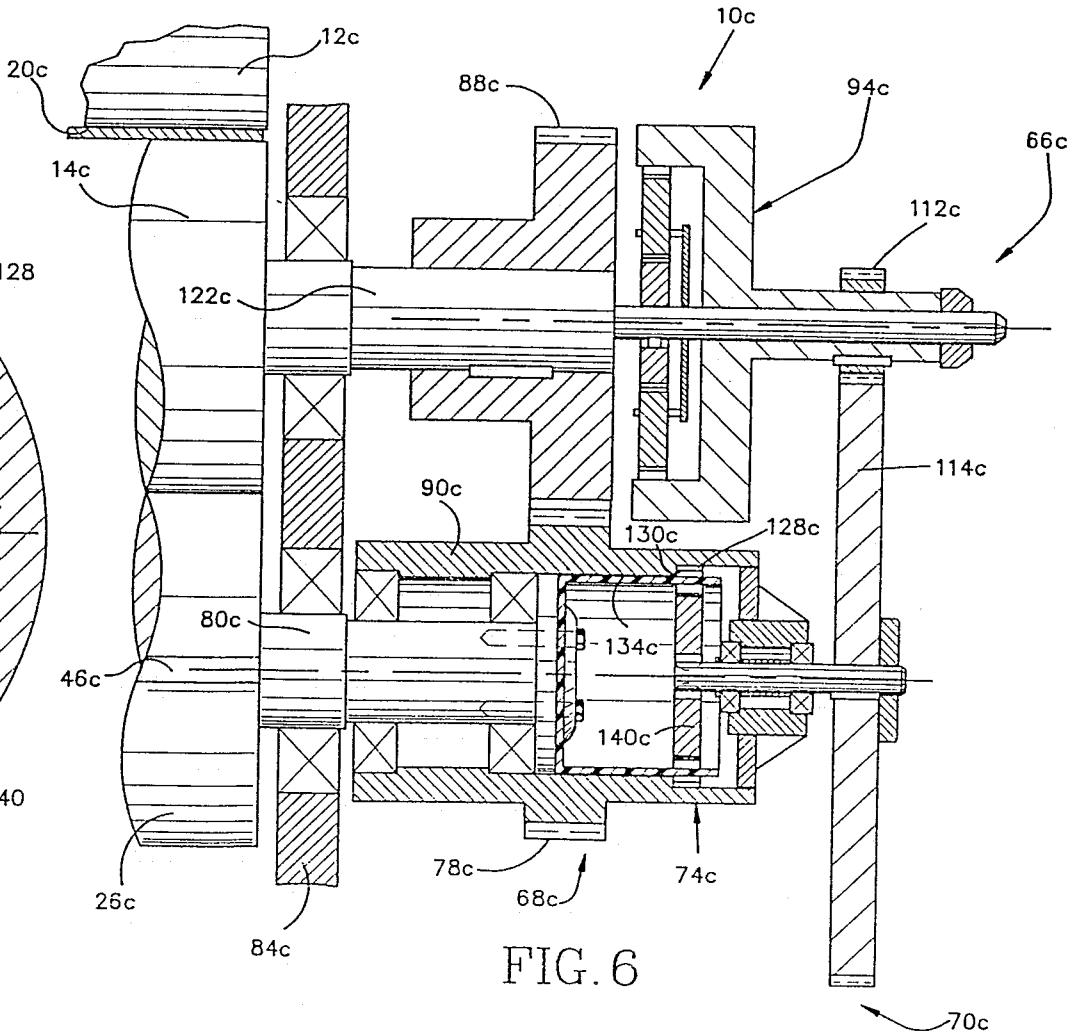
FIG. 6 is a schematic sectional view, generally similar to FIG. 3, illustrating an embodiment of the invention in which the harmonic drive unit is connected with a plate cylinder.

In the embodiment of the invention illustrated in FIG. 6, the drive assembly 66c includes a main drive 68c and a secondary drive 70c. The main drive 68c includes a harmonic drive unit 74c which is connected with a plate cylinder gear 78c disposed in a coaxial relationship with and connected to a plate cylinder 26c by the harmonic drive unit 74c. A blanket cylinder gear 88c is fixedly connected with the shaft 122c of the blanket cylinder 14c. The blanket cylinder gear 88c is disposed in a coaxial relationship with the blanket cylinder 14c and is disposed in meshing engagement with the plate cylinder gear 78c.

A planetary gear set 94c in the secondary drive train 70c is disposed in a coaxial relationship with and is driven by the blanket cylinder shaft 122c. The planetary gear set 94c drives spur gears 112c and 114c to rotate a second input member or wave generator 140c in the harmonic drive unit 74c. The output member 134c of the harmonic drive unit 74c is fixedly connected with the shaft 80c of the blanket cylinder 26c.

In the specific embodiment of the invention illustrated in FIG. 6, the plate cylinder gear 78c is a ten pitch-72 tooth gear and the blanket cylinder gear 88c is a ten pitch-73 tooth gear. Therefore, upon each revolution of the blanket cylinder gear 88c, the plate cylinder gear 78c and input member 90c rotate through a distance which is slightly more than one complete revolution.

The planetary gear set 94c has a 200-to-1 drive ratio. The spur gears 112c and 114c have a 5-to-1 drive ratio with the spur gear 112c being a twelve pitch-29 tooth gear and the spur gear 114c being a twelve pitch-145 tooth gear. The harmonic drive unit 74c has a 73-to-72 drive ratio. Thus, there are 156 internal teeth 128c on the input member 90c and 154 external teeth 130c on the output member 134c.

During operation of the lithographic printing press 10c, the main press drive train (not shown) drives the blanket cylinder gear 88c. Rotation of the blanket cylinder gear 88c rotates the plate cylinder gear 78c and plate cylinder 26c at a slightly faster speed than the blanket cylinder gear.

Drive forces from the plate cylinder gear 78c are transmitted to the plate cylinder 26c through the internal teeth 128c on the input member 90c of the harmonic drive unit 74c and through the external teeth 130c on the output member 134c which is fixedly connected to the plate cylinder 26c. The ratio of the number of internal teeth 128c on the input member 90c to the ratio of the number of external teeth 130c on the output member 134c is such that the plate cylinder 26c rotates at the same surface speed as the blanket cylinder 14c in the absence of rotation of the wave generator 140c by the secondary drive 70c.

The secondary drive 70c rotates the wave generator 140c in the opposite direction from the direction of rotation of the plate cylinder gear 78c. Therefore, the input of the secondary drive 70c is effective to retard the rotation of the plate cylinder 26c. This results in the plate cylinder 26c being driven at a slightly slower surface speed than the blanket cylinder 14c. Therefore, there is continuous relative rotation between the plate cylinder 26c and plate cylinder gear 78c during printing on the sheet material web 20c.

The plate cylinder 26c is rotated at a surface speed which is slightly slower than the surface speed at which the blanket cylinder 14c rotates. Therefore, the location where a first image is transferred from the plate cylinder 26c to the surface of the blanket cylinder 14c is ahead of the location where the next succeeding image is transferred to the surface of the blanket cylinder is between 0.0001 and 0.0004 inches. In the illustrated embodiment of the invention, the images were spaced apart by 0.0003 inches.

Conclusion

In view of the foregoing remarks, it is apparent that a lithographic printing press 10 constructed in accordance with the present invention to minimize ink build up and blanket wear. This is accomplished by rotating the plate cylinders 24 and 26 at a surface speed which is different than the surface speed of the blanket cylinders 12 and 14.

Since the plate cylinders 24 and 26 are rotating at a different surface speed than the blanket cylinders 12 and 14, the area on a blanket cylinder 12 or 14 which engages a given portion of the surface area on a plate cylinder 24 or 26 is changed on each revolution of the blanket cylinder. Therefore, the area of a blanket cylinder 12 or 14 which is engaged by a gap 44 or 46 on a plate cylinder 24 or 26 changes during a printing operation. This prevents a gap 44 or 46 in a plate cylinder 24 or 26 from repeatedly striking a blanket at the same location to thereby minimize blanket wear, deformation and/or damage during the printing operation.

Since the plate cylinders 24 and 26 are being rotated at a different surface speed than the blanket cylinders 12 and 14, the area where an image is applied to a blanket cylinder 12 or 14 is moved relative to the surface of the blanket cylinder during printing. This tends to minimize build up of ink on a blanket cylinder 12 or 14 to thereby eliminate or reduce the need for washing of the blanket cylinder.

Having described specific preferred embodiments of the invention, the following is claimed:

1. An apparatus operable to repetitively print the same image on sheet material, said apparatus comprising a rotatable plate cylinder having a peripheral surface for carrying the image to be printed on the sheet material, a rotatable blanket cylinder having a peripheral surface disposed in engagement with the peripheral surface of said plate cylinder to receive the image to be printed on the sheet material from said plate cylinder, and drive means connected with said cylinders for continuously rotating said plate and blanket cylinders during operation of said apparatus to print on sheet material, said drive means including a blanket cylinder gear connected in a coaxial relationship with said blanket cylinder, a plate cylinder gear connected in a coaxial relationship with said plate cylinder and disposed in meshing engagement with said blanket cylinder gear, and means for continuously rotating a first one of said cylinders relative to the one of said gears connected in a coaxial relationship with said first one of said cylinders throughout operation of said apparatus to print one sheet material.

2. An apparatus as set forth in claim 1 wherein said blanket cylinder gear having a first number of gear teeth, said plate cylinder gear having a second number of gear teeth which is different than said first number of gear teeth, the ratio of said first number of gear teeth to said second number of gear teeth being different than the ratio of the diameter of said blanket cylinder to the diameter of said plate cylinder.

3. An apparatus as set forth in claim 1 wherein said plate cylinder has a longitudinally extending gap in its peripheral surface, said gap in said plate cylinder engaging the peripheral surface of said blanket cylinder at a first location during a first one of the revolutions of said blanket cylinder and engaging the peripheral surface of said blanket cylinder at a second location during a second one of the revolutions of said blanket cylinder, said second location being offset from and closely adjacent to said first location.

4. An apparatus as set forth in claim 3 wherein said second location is offset from said first location by a distance of 0.0001 to 0.0004 inches along the peripheral surface of said blanket cylinder.

5. An apparatus as set forth in claim 1 wherein said drive means rotates said plate and blanket cylinders at surface speeds which differ by an amount necessary to shift the area of engagement of the surface of the plate cylinder with the surface of the blanket cylinder by 0.0001 to 0.0004 inches along the surface of the blanket cylinder during each revolution of the blanket cylinder.

6. An apparatus as set forth in claim 1 wherein said drive means is operable to move a point of engagement of said plate cylinder with the surface of said blanket cylinder by at least 0.0001 inches along the surface of said blanket cylinder during each revolution of said blanket cylinder while said apparatus is printing on sheet material.

7. An apparatus as set forth in claim 1 wherein said means for continuously rotating one of said cylinders relative to the one of said gears connected in a coaxial relationship with said one cylinder includes a harmonic drive unit and means for continuously operating said harmonic drive unit during operation of said apparatus to print on sheet material.

8. An apparatus as set forth in claim 7 wherein said means for continuously operating said harmonic drive unit includes gear means having an input which is rotated with a second one of said cylinders and an output connected with said harmonic drive unit.

9. An apparatus as set forth in claim 8 wherein said harmonic drive unit includes a rotatable element connected to and rotatable with the one of said gears which is coaxial with said first one of said cylinders, said rotatable element having internal teeth, a flexible output member having external teeth disposed in meshing engagement with said internal teeth of said rotatable element, said flexible output member being rotatable relative to said rotatable element, wave generator means for continuously flexing said flexible output member relative to said rotatable element to cause said internal and external teeth to continuously rotate said flexible output member relative to said rotatable element and the one of said gears which is coaxial with said first one of said cylinders during operation of said apparatus to print on sheet material, means for connecting said flexible output member to said first one of said cylinders for rotation therewith, and means for connecting said wave generator means to the output of said gear means to enable said gear means to continuously rotate said wave generator means during operation of said apparatus to print on sheet material.

10. An apparatus as set forth in claim 1 wherein said drive means is operable to rotate said plate and blanket cylinders at different surface speeds during operation of said apparatus to print on sheet material.

11. An apparatus as set forth in claim 1 wherein said drive means is operable to move a point of engagement of said plate cylinder with the surface of said blanket cylinder by at least 0.0001 inches in the same direction along the surface of said blanket cylinder during each revolution of said blanket cylinder during operation of said apparatus to print on sheet material.

12. An apparatus operable to print on sheet material, said apparatus comprising a rotatable plate cylinder having a peripheral surface for carrying an image to be printed on the sheet material, a rotatable blanket cylinder having a peripheral surface disposed in engagement with the peripheral surface of said plate cylinder to receive the image to be printed on the sheet material from said plate cylinder, and drive means connected with said cylinders for continuously rotating said plate and blanket cylinders at different surface speeds to continuously shift the location of the image on the peripheral surface of said blanket cylinder in the same direction along the surface of said blanket cylinder during the operation of said apparatus to print on the sheet material.

13. An apparatus as set forth in claim 12 wherein said drive means includes gear means which interconnects said plate and blanket cylinders and which has a gear ratio which is different than the ratio of the diameters of said cylinders.

14. An apparatus as set forth in claim 12 wherein said drive means includes a harmonic drive unit, said harmonic drive unit including a rotatable input member having internal teeth, a flexible output member having external teeth disposed in meshing engagement with the internal teeth on said input member, said output member being rotatable relative to said input member, wave generator means for flexing said output member relative to said input member to cause said internal and external teeth to rotate said output member relative to said input member, means for connecting said output member to a first one of said cylinders for rotation therewith, first gear means for continuously rotating said input member during rotation of a second one of said cylinders, and second gear means interconnecting said second one of said cylinders and said wave generator means for continuously rotating said wave generator means during rotation of said second one of said cylinders.

15. An apparatus as set forth in claim 12 wherein said drive means is operable to move the location at which a point on said plate cylinder engages said blanket cylinder through a distance of 0.0001 to 0.0004 inches in the same direction along the surface of the blanket cylinder upon each revolution of said blanket cylinder during operation of said apparatus to print on the sheet material.

16. A method as set forth in claim 12 wherein said step of continuously rotating the plate and blanket cylinders includes transferring force between the plate and blanket cylinders through plate and blanket cylinder gears which are disposed in meshing engagement with the plate cylinder gear coaxial with the plate cylinder and the blanket cylinder gear coaxial with the blanket cylinder, said step of continuously changing the location on the blanket cylinder to which the image is transferred by transferring the image from the plate cylinder to a different location on the blanket cylinder during each revolution of the blanket cylinder including continuously rotating one of said cylinders relative to the one of said gears which is disposed in a coaxial relationship with the one cylinder during printing on the sheet material.

17. A method of printing on sheet material, said method comprising the steps of continuously rotating a plate cylinder carrying an image during printing on the sheet material, continuously rotating a blanket cylinder with a peripheral surface of the blanket cylinder in engagement with a peripheral surface of the rotating plate cylinder to transfer the image from the plate cylinder to the blanket during printing on the sheet material, said steps of rotating the plate and blanket cylinders including continuously rotating the plate and blanket cylinders at different surface speeds during printing on the sheet material, and continuously changing the location on the blanket cylinder to which the image is transferred during printing on the sheet material by transferring the image from the plate cylinder to a different location on the blanket cylinder during each revolution of the blanket cylinder with the location of the image transferred to the blanket cylinder on each revolution of the blanket cylinder being offset from the location of the image on the next preceding revolution of the blanket cylinder by a distance of 0.0001 to 0.004 inches along the surface of the blanket cylinder.

18. A method as set forth in claim 17, wherein said step of continuously rotating the plate and blanket cylinders includes transferring force between the plate and blanket cylinders through a harmonic drive unit, said step of continuously changing the location on the blanket cylinder to which the image is transferred includes continuously operating the harmonic drive unit to transmit force between the plate and blanket cylinders during printing on the sheet material.

19. A method of printing on sheet material, said method comprising continuously rotating a plate cylinder carrying an image during printing on the sheet material, continuously rotating a blanket cylinder during printing on the sheet material, and during each revolution of the blanket cylinder during printing on the sheet material, transferring an image from the plate cylinder to a location on the blanket cylinder which at least partially overlies and is offset from and closely adjacent to the location of the same image on the blanket cylinder during the preceding revolution of the blanket cylinder, said step of transferring an image from the plate cylinder to a location on the blanket cylinder which at least partially overlies and is offset from and closely adjacent to the location of the same image on the blanket cylinder during the preceding revolution of the blanket cylinder being repeated during each revolution of the blanket cylinder with the image being offset in the same direction along the surface of the blanket cylinder.

20. A method as set forth in claim 19 wherein said step of rotating a blanket cylinder includes continuously rotating the blanket cylinder at a first surface speed during printing on the sheet material, said step of rotating a plate cylinder includes continuously rotating a plate cylinder at a second surface speed which is different than the first surface speed during printing on the sheet material.

21. A method as set forth in claim 19 wherein said step of continuously rotating the plate and blanket cylinders includes continuously operating a harmonic drive unit to continuously transmit force through the harmonic drive unit to one of the cylinders to rotate the one cylinder at a different surface speed than the other cylinder.

22. A method as set forth in claim 19 wherein said step of transferring an image from the plate cylinder to a location on the blanket cylinder includes transferring an image from the plate cylinder to a location which is offset by a distance of 0.0001 to 0.0004 inches along the peripheral surface of the blanket cylinder from the location of the same image during the preceding revolution of the blanket cylinder.

23. A method as set forth in claim 19 wherein said step of continuously rotating the plate and blanket cylinders includes transferring force between the plate and blanket cylinders through plate and blanket cylinder gears which are disposed in meshing engagement with the plate cylinder gear coaxial with the plate cylinder and the blanket cylinder gear coaxial with the blanket cylinder, said step of transferring an image from the plate cylinder to a location on the blanket cylinder which at least partially overlies and is offset from the closely adjacent to the location of the same image on the blanket cylinder during the preceding revolution on the blanket cylinder includes continuously rotating one of said cylinders relative to the one of said gears which is disposed in a coaxial relationship with the one cylinder during printing on the sheet material.

24. A method of printing on sheet material, said method comprising the steps of continuously rotating a plate cylinder having a longitudinally extending gap in its peripheral surface during printing on the sheet material, continuously rotating a blanket cylinder with a peripheral surface of the blanket cylinder in engagement with the peripheral surface of the plate cylinder during printing on the sheet material, and, during each revolution of the blanket cylinder throughout the time during which the plate and blanket cylinders are being rotated to print on sheet material, engaging the peripheral surface of the blanket cylinder with the longitudinally extending gap in the peripheral surface of the plate cylinder at a location which is offset from a location where the gap in the peripheral surface of the plate cylinder engaged the peripheral surface of the blanket cylinder on the preceding revolution of the blanket cylinder, said step of engaging the peripheral surface of the blanket cylinder with the longitudinally extending gap in the peripheral surface of the plate cylinder includes offsetting the location where the gap in the peripheral surface of the plate cylinder engages the blanket cylinder by a distance of 0.0001 to 0.0004 inches in the same direction along the surface of the blanket cylinder during printing on the sheet material.

25. A method as set forth in claim 24 wherein said step of rotating the blanket cylinder includes continuously rotating the blanket cylinder at a first surfacer speed during printing on the sheet material, said step of rotating a plate cylinder includes continuously rotating the plate cylinder at a second surface speed which is different from the first surface speed during printing on the sheet material.

* * * * *

UNITED STATES PATENT AND TRADEMARK OFFICE

CERTIFICATE OF CORRECTION

PATENT NO. : 4,953,461

DATED : September 4, 1990

INVENTOR(S) : John M. Gaffney, Wilfred R. Gelinas, Joel C. Hern, Charles L. Krouse It is certified that error appears in the above-identified patent and that said Letters Patent is hereby corrected as shown below:

Column 9, Line 53, Claim 1, Change "one" to --on--.

Column 12, Line 2, Claim 17, Insert --cylinder-- between "blanket" and "during".

Column 12, Line 15, Claim 17, Change "0.004" to --0.0004--.

Column 13, Line 10, Claim 23, Change "the" to --and--.

Column 13, Line 12, Claim 23, Change "on" to --of--.

Column 14, Line 19, Claim 25, Change "surfacer" to --surface--.

On the title page in [54], the title, Line 2, Change "A" to --AND--.

On the title page in the name of the firm, change "Sunheim" to --Sundheim--.

Signed and Sealed this

Twenty-eighth Day of January, 1992

*Attest:*

HARRY F. MANBECK, JR.

*Attesting Officer*

*Commissioner of Patents and Trademarks*